US011219983B2

(12) United States Patent
Tseng et al.

(10) Patent No.: US 11,219,983 B2
(45) Date of Patent: Jan. 11, 2022

(54) GRIPPER DEVICE

(71) Applicant: TOYO AUTOMATION CO., LTD., Tainan (TW)

(72) Inventors: Kun Cheng Tseng, Tainan (TW); Kuei Tun Teng, Tainan (TW); Hsiang Wei Chen, Tainan (TW)

(73) Assignee: TOYO AUTOMATION CO., LTD., Tainan (TW)

( * ) Notice: Subject to any disclaimer, the term of this patent is extended or adjusted under 35 U.S.C. 154(b) by 133 days.

(21) Appl. No.: 16/551,808

(22) Filed: Aug. 27, 2019

(65) Prior Publication Data

US 2020/0353596 A1 Nov. 12, 2020

(30) Foreign Application Priority Data

May 10, 2019 (TW) ..... 108116255

(51) Int. Cl.
*B25B 5/02* (2006.01)
*B25B 5/10* (2006.01)

(52) U.S. Cl.
CPC ..... *B25B 5/02* (2013.01); *B25B 5/102* (2013.01)

(58) Field of Classification Search
CPC ..... B25B 11/00; B25B 5/02; B25B 5/102; B23Q 7/04; B23Q 2003/155407; B25J 15/026
See application file for complete search history.

(56) References Cited

U.S. PATENT DOCUMENTS 5,061,125 A * 10/1991 Kuppinger ..... B23B 29/03478 408/150
5,122,030 A * 6/1992 Schmeisser ..... B23K 37/047 198/418.3
2003/0108255 A1* 6/2003 Teramach ..... F16C 29/063 384/45
2010/0290873 A1* 11/2010 Bonora ..... H01L 21/67733 414/267
2012/0061155 A1* 3/2012 Berger ..... B25J 5/007 180/21
2017/0080578 A1* 3/2017 Williams ..... B25J 15/026

* cited by examiner

*Primary Examiner* — Stephen A Vu
(74) *Attorney, Agent, or Firm* — Bacon & Thomas, PLLC

(57) ABSTRACT

The present disclosure relates to a gripper device which comprises: a belt pulley driven by a power-driven motor; a belt and another belt pulley driven by the above belt pulley; a ball screw driven and rotated by the belt pulley; nut brackets driven to be shifted along two rigid guideways by two reverse threads at both sides of the ball screw, respectively; a plurality of steel balls, which are installed between a nut bracket and a rigid guideway and sustain more stresses when a workpiece is clamped between two upper slide on the nut brackets.

9 Claims, 10 Drawing Sheets

GRIPPER DEVICE

BACKGROUND OF THE INVENTION

1) Field of the Invention

The present disclosure relates to a grip-supporting device, particularly a device which comprises rigid guideways and a plurality of corresponding steel balls sustaining more stresses for less installation space when a workpiece has been clamped.

2) Description of the Prior Art

An object to be gripped with a tool was a common request of human beings who had made use of tools; in this regard, a gripping portion of a tool has been improved with progressive machining technologies since long time ago. Nowadays, a gripper device as a clamping tool widely used in the industry proves effective in clamping a workpiece at a fixed position.

The patent documentations with respect to grippers are shown as follows:

R.O.C. patent TW 1639492 discloses an opening and closing chuck which comprises: a linear guideway outside a chuck body; a pair of protuberant fingers mounted on the guideway and used to grip a workpiece wherein at least one of the pair of protuberant fingers is a moveable protuberant finger freely shifted along the guideway; a pneumatic cylinder device installed inside the chuck body and comprising a piston as well as a piston lever, both of which are shifted in the axial direction of the pneumatic cylinder device based on pneumatic pressures. An opening and closing chuck is provided with pneumatic cylinder devices and moveable protuberant fingers, each of which is equal to the counterpart in number. The piston lever has a front-end part which protrudes from one terminal of the chuck body; the piston lever is provided with an end block which is located at the front-end part protruding from the end part of the chuck body and connected with the moveable protuberant finger.

China patent CN1246128C discloses an opening and closing gripper which is provided with a pair of chuck members clamping a workpiece and a rail directing the chuck members to be opened or closed on a first surface at which a support body is fixed and a second surface of a gripper body opposite to a second surface of the support body. Moreover, the opening and closing gripper also comprises: several fixing holes for fixing the support body on the first surface at which the rail and each of the chuck members contact with each other; operation holes at each chuck member for screws penetrating the fixing holes.

To securely clamp a workpiece, a chuck device needs a source of chucking power as well as a transmission structure. A source of chucking power may be an operator's hands or levers and cams in early days or stem from physical principles including ball screw, vacuum, magnetism, hydraulic force or pneumatic force currently, particularly magnetism, hydraulic force or pneumatic force adequate to automatic clamp. As shown in the opening and closing chuck, R.O.C. patent TW 1639492, a piston and a piston lever, both of which are shifted in the axial direction of the pneumatic cylinder device back and forth based on pneumatic pressures, rely on the pneumatic cylinder device as a source of chucking power which is transmitted by a piston lever. Moreover, as shown in the opening and closing gripper, China patent CN1246128C, a pair of cylinder mechanisms have a pair of cylinder holes opened in the chuck body and being parallel to each other as well as pistons freely shifted in the cylinder holes. The pistons shifted reversely under fluid pressures rely on the pair of cylinder mechanisms as the source of chucking power which is transmitted by a gear rack and toothed wheels.

As mentioned previously, a gripper device to clamp a workpiece controllably should be shifted and coordinate with a carrier mechanism for movement according to clamping components supplemented by a guideway component. As shown in the opening and closing chuck, R.O.C. patent TW 1639492, a workpiece is clamped by a pair of protuberant fingers matching a single guideway which sustain stresses induced by the clamped workpiece. On the other hand, as shown in the opening and closing gripper, China patent CN1246128C, a workpiece is clamped and guided through a pair of chuck members matching a single rail which sustain stresses induced by the clamped workpiece.

However, a single guideway/rail on which a shaky workpiece is carried is not stable enough or a gripper on which return member for promotion of stability is installed additively needs more space for the installation of the ball re circulator return member from which noises are generated between colliding steel balls. Against this background, a gripper device is provided in the present disclosure for settling above problems.

SUMMARY OF THE INVENTION

In virtue of the above problems, a gripper device provided in the present disclosure is characteristic of rigid guideways matching steel balls structurally for better stability.

A gripper device provided in the present disclosure relies on guideways matching steel balls structurally without return member occupying more space.

A gripper device provided in the present disclosure is characteristic of steel ball grooves in which steel balls are accommodated such that no noise is generated by return member and colliding steel balls.

A gripper device provided in the present disclosure is characteristic of a plurality of steel balls which are accommodated between a guideway and a nut bracket such that an upper slide socket clamping a workpiece sustains more stresses.

A gripper device provided in the present disclosure relies on a ball nut installed inside a nut bracket for the stability of a gripper device which is clamping or loosening a workpiece.

A gripper device provided in the present disclosure relies on ball bearings which are installed at both sides of a ball screw and prevents packing nuts to be fixed from being friction directly.

To this end, a gripper device is embodied according to the following technical measures. For a gripper device in the present disclosure, a belt pulley is driven by a transmission shaft of a power-driven motor fixed on a first anchor plate clockwise or counterclockwise; both a belt and another belt pulley are also driven by the belt pulley; a ball screw is driven and rotated by the belt pulley fixed on the ball screw; two ball nuts inside two nut brackets are driven by two reverse threads at both sides of the ball screw, respectively; the ball nut regulated by a packing nut is limitedly shifted in the same axial direction of the ball screw; the nut brackets are shifted along two rigid guideways; the rigid guideways are installed between a first anchor plate and a second anchor plate; a plurality of steel balls between a nut bracket and a rigid guideway sustain more stresses when a workpiece is clamped between two upper slide sockets on the nut brackets.

A gripper device is further embodied according to the following technical measures.

The gripper device wherein said nut bracket comprises two steel ball grooves in which said steel balls are accommodated.

The gripper device comprises a plurality of guard strips mounted at both sides of a nut bracket.

The gripper device wherein said rigid guideway comprises two guideway areas and a blockage area between said guideway areas.

The gripper device comprises a ball bearing between said packing nut and said first anchor plate.

The gripper device wherein said steel balls are stably shifted along a rigid guideway with a retention slot on said first anchor plate and another retention slot on said second anchor plate abutting said rigid guideway.

The gripper device comprises a dustproof shell which prevents said ball screw from being pollution.

The gripper device wherein said upper slide sockets match a plurality of fixture blocks to clamp a workpiece stably.

The gripper device wherein said steel balls do not contact with said guard strips directly.

In contrast to prior arts, a gripper device in the present disclosure proves effective in (1) a guideway matches steel balls structurally for no-ball re-circulator occupying more space; (2) a plurality of steel balls are placed between a guideway and a nut bracket such that upper slide sockets between which a workpiece is clamped sustains more stresses; (3) a rigid guideway matches steel balls for better stability.

BRIEF DESCRIPTIONS OF THE DRAWINGS

Figure 3A:
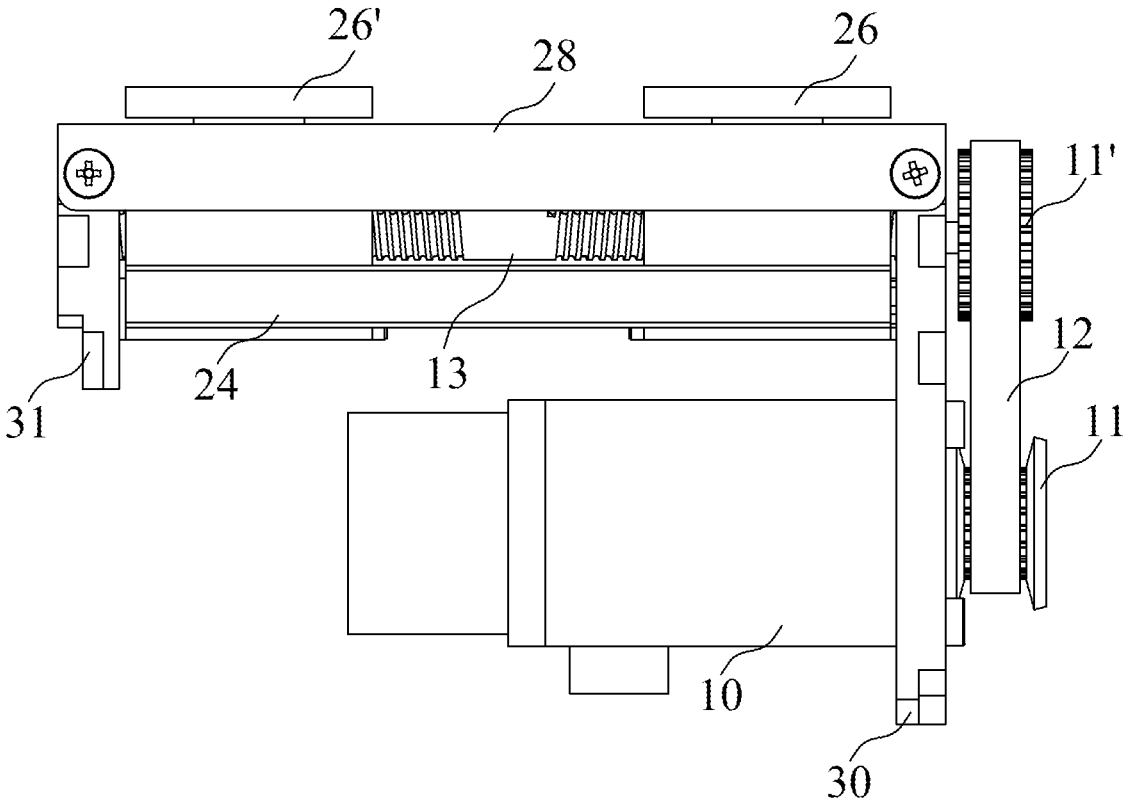
Figure 3B:
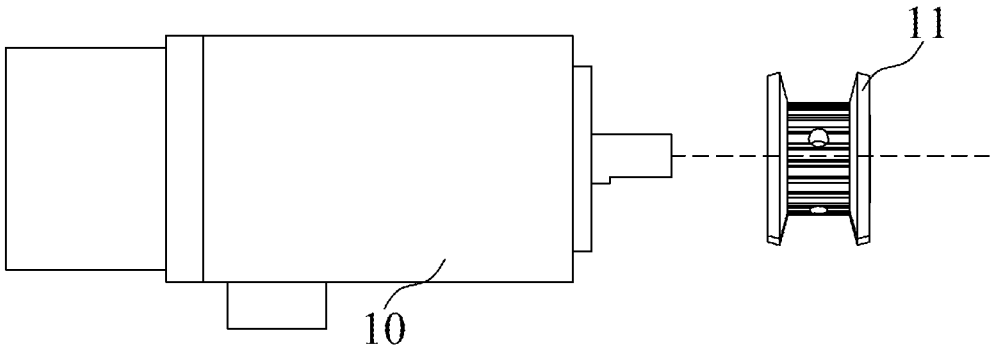
Figure 3C:
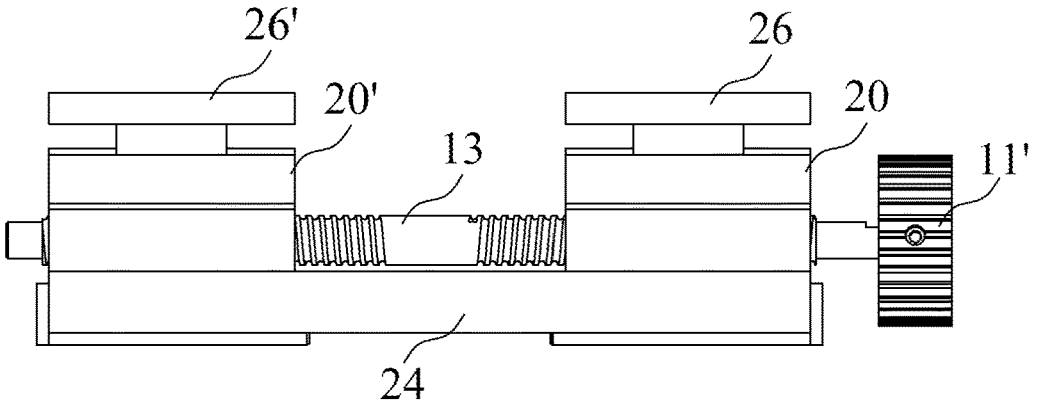
Figure 3D:
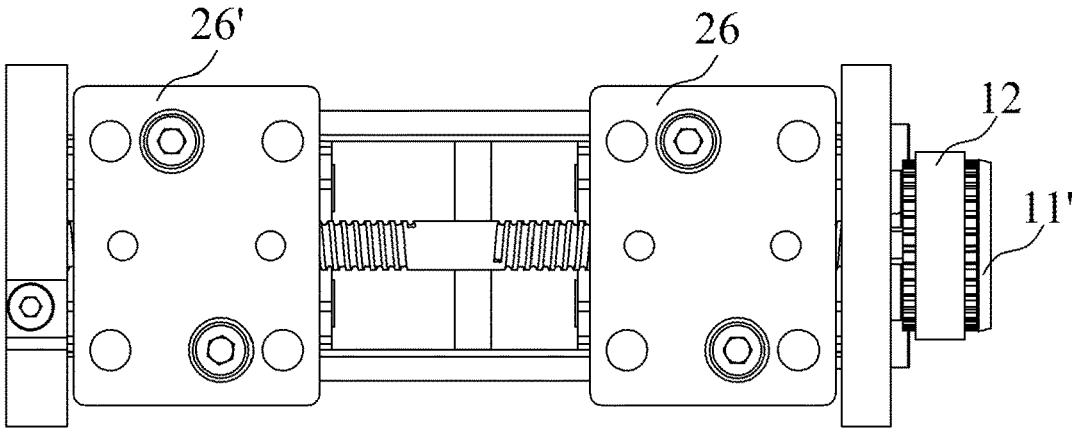
Figure 4A:
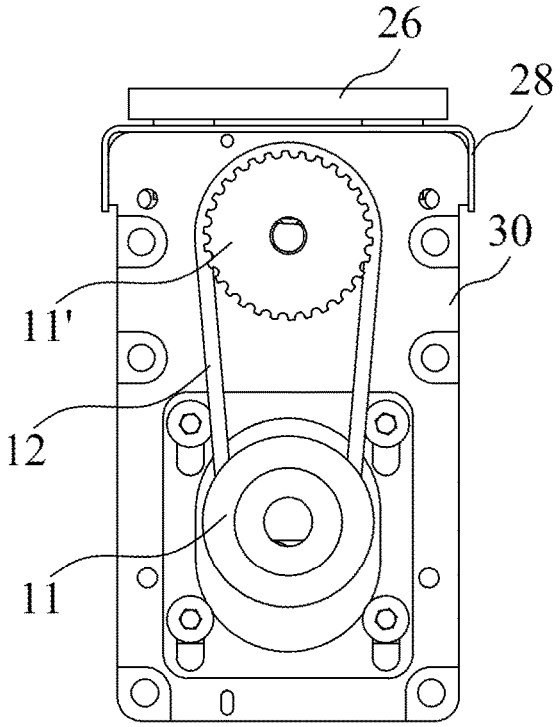
Figure 4B:
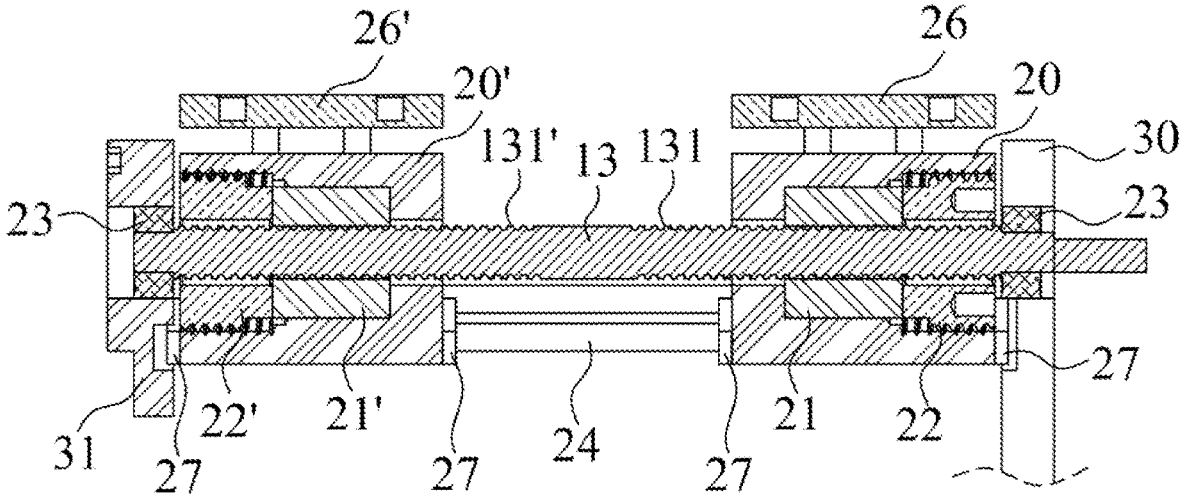
Figure 5A:
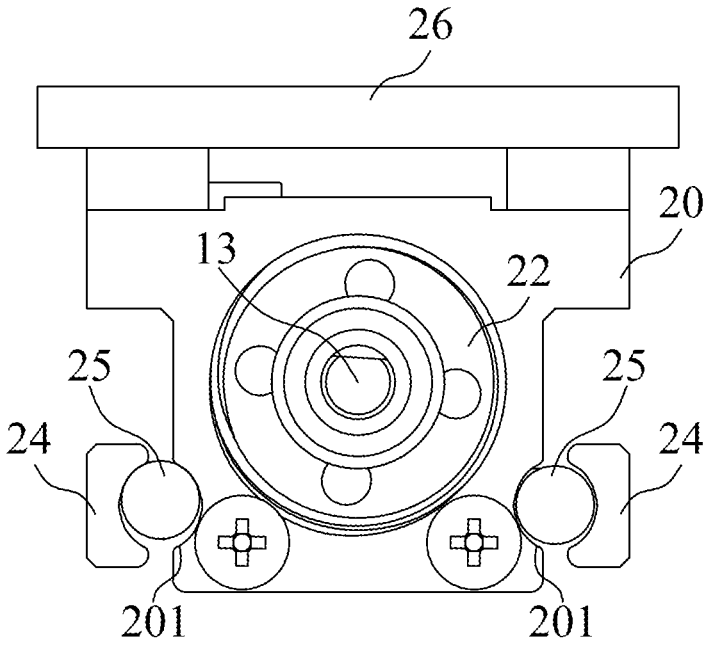
Figure 5B:
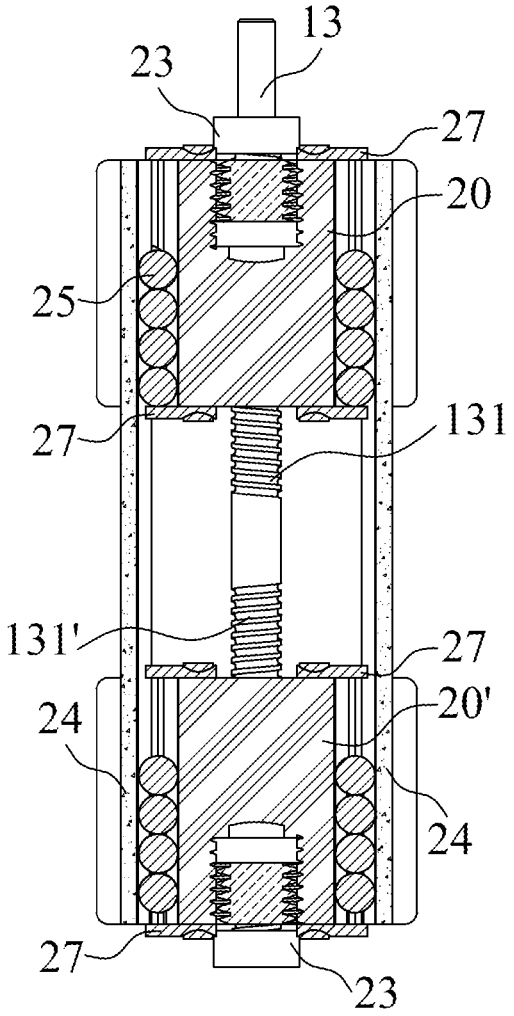
Figure 5C:
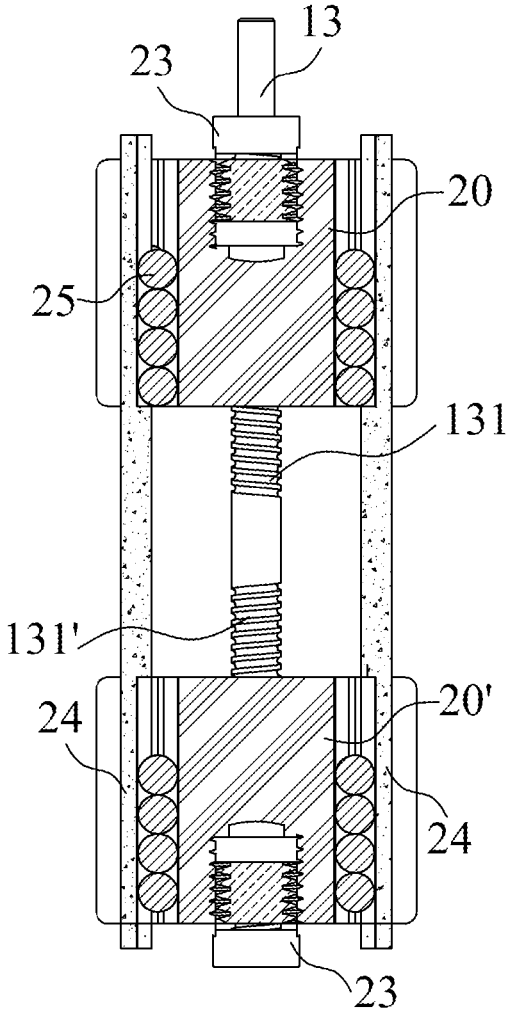
Figure 6A:
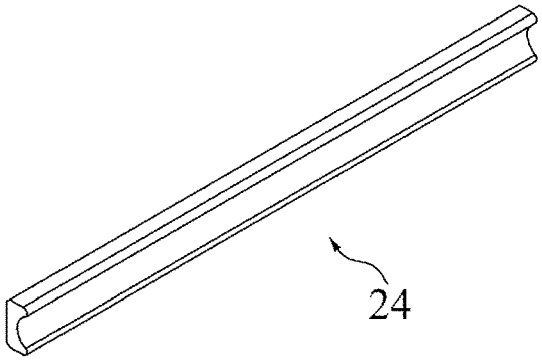
Figure 6B:
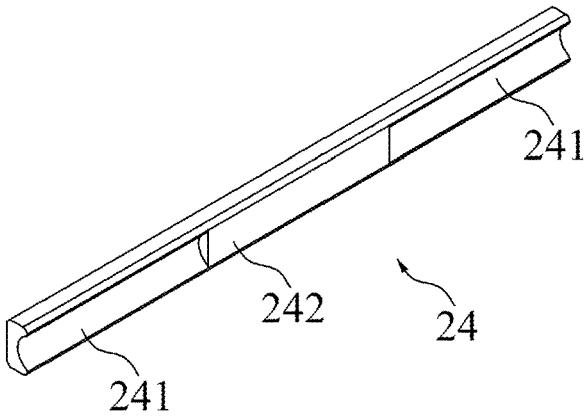
Figure 7:
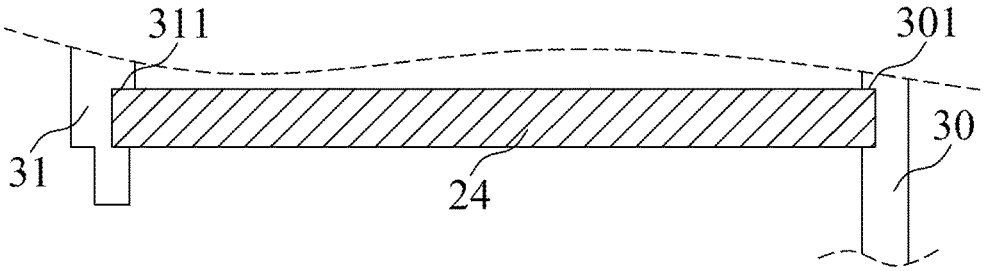
Figure 8:
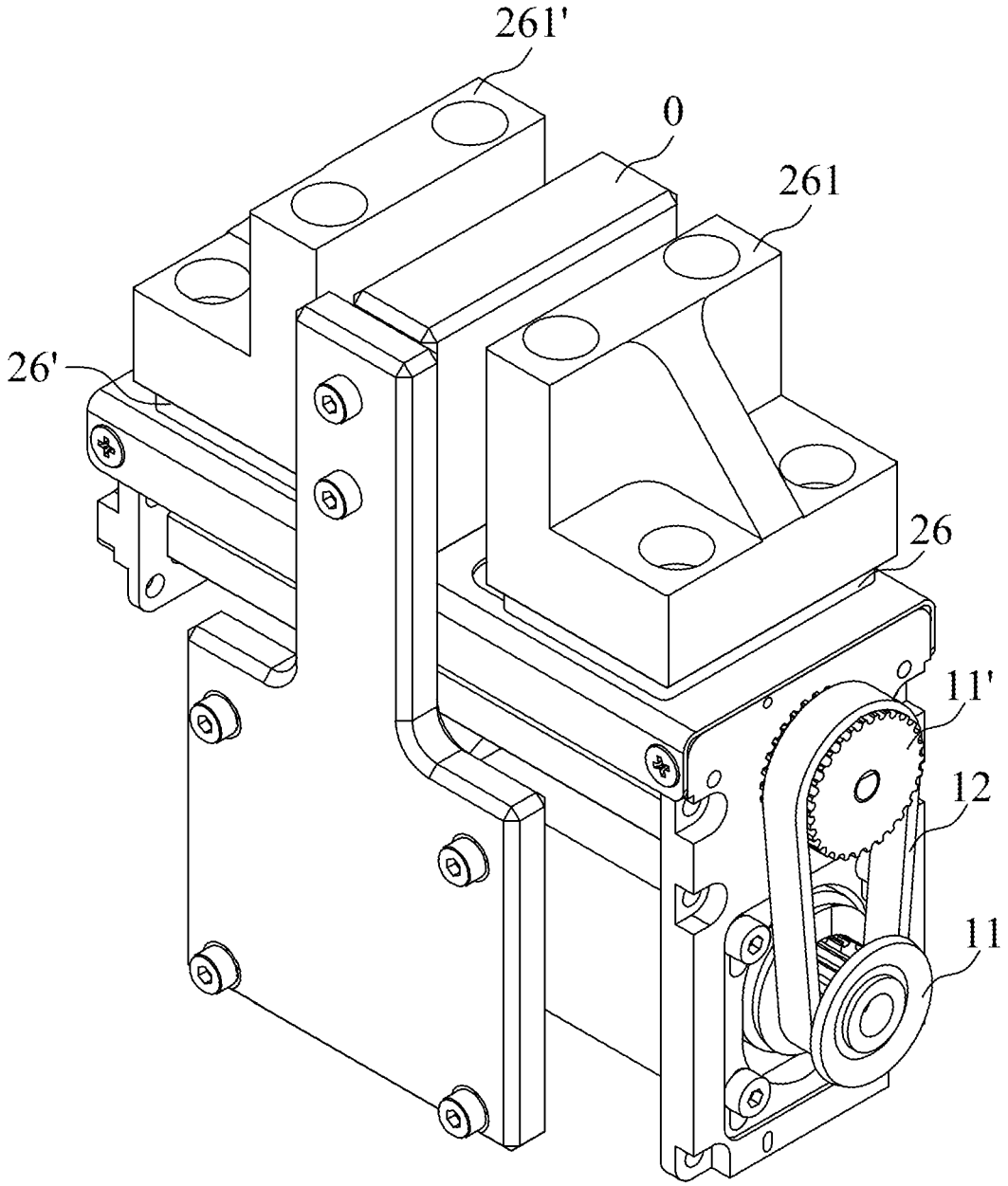

FIG. 3*a* is a first side view of a gripper device in a preferred embodiment;

FIG. 3*b* is a schematic view of a motor assembled in a gripper device in a preferred embodiment;

FIG. 3*c* is a schematic view of a ball screw assembled in a gripper device in a preferred embodiment;

FIG. 3*d* is a first top view of a gripper device in a preferable embodiment;

FIG. 4*a* is a schematic view of a belt pulley in a gripper device in a preferable embodiment;

FIG. 4*b* is a schematic cross-sectional view of a ball screw in a gripper device in a preferable embodiment;

FIG. 5*a* is a schematic view for steel balls mounted on a gripper device in a preferable embodiment;

FIG. 5*b* is a first schematic cross-sectional view of steel balls in a gripper device in a preferable embodiment;

FIG. 5*c* is a second schematic cross-sectional view of steel balls in a gripper device in a preferable embodiment;

FIG. 6*a* is a first schematic view of a rigid guideway in a gripper device in a preferable embodiment;

FIG. 6*b* is a second schematic view of a rigid guideway in a gripper device in a preferable embodiment;

FIG. 7 is a schematic view of a rigid guideway fixed in a gripper device in a preferable embodiment;

FIG. 8 is a schematic view of a workpiece clamped with a gripper device in a preferable embodiment.

DETAILED DESCRIPTIONS OF THE PREFERRED EMBODIMENTS

A gripper device is explained in the preferred embodiments for a clear understanding of purposes, characteristics and effects of the present disclosure.

Referring to FIG. 3*a* for the first embodiment, which illustrates a gripper device comprising a power-driven motor (10), two belt pulleys (11, 11'), a belt (12) and a ball screw (13) for transmission of the driving force.

Moreover, referring to FIG. 3*a*, which illustrates the power-driven motor (10) is fixed in a first anchor plate (30); referring to FIG. 3*b*, which illustrates one belt pulley (11) is driven by a transmission shaft of the power-driven motor (10) clockwise or counterclockwise; referring to FIG. 4*a*, which illustrates the belt (12) and the other belt pulley (11') are also driven by the belt pulley (11); referring to FIG. 3*c*, which illustrates the ball screw (13) is driven and rotated by the belt pulley (11') fixed on the ball screw (13).

In specific, the first anchor plate (30) that is a laminar structure on which components are fixed comprises a plurality of holes and/or grooves (for example, retention slots 301 in FIG. 7) for installations of relevant components; the power-driven motor (10) also known as an electric motor is an electric device transforming power energy to mechanical energy with which kinetic energy is generated for driving other facilities; the belt pulleys (11, 11') correspondingly installed on a high-precision positioning mechanism for reduced counterforce are adequate to high-speed low-torque transmission which is enabled by frictional forces between the belt pulleys (11, 11') and the belt (12) made of elastic and tenacious materials for noise-free transmission in contrast to a chain or gears; the belt (12) which is an elastic component generates low noise during transmission such that a machine sustains low vibrations; the ball screw (13) featuring its cylindrical surface with concavo-convex spiral threads usually is able to transform the screw movement to the linear movement for generations of linear forces induced by torques and transmissions of acting forces which are magnified axially by smaller rotary forces (from torques) applied on a shaft.

As shown in FIG. 4*b*, the ball screw (13) comprises two reverse threads (131, 131') thereon, which are a right-handed thread and a left-handed thread, respectively; accordingly, a distance between components mounted on the ball screw (13) is controlled by the rotary ball screw (13).

Moreover, referring to FIGS. 4*b* and 5*b*, which illustrate a gripper device comprises two nut brackets (20, 20'), two ball nuts (21, 21'), two packing nuts (22), two rigid guideways (24), a plurality of steel balls (25), two upper slide sockets (26, 26') and a plurality of guard strips (27) for clamping a workpiece.

Figure 1:
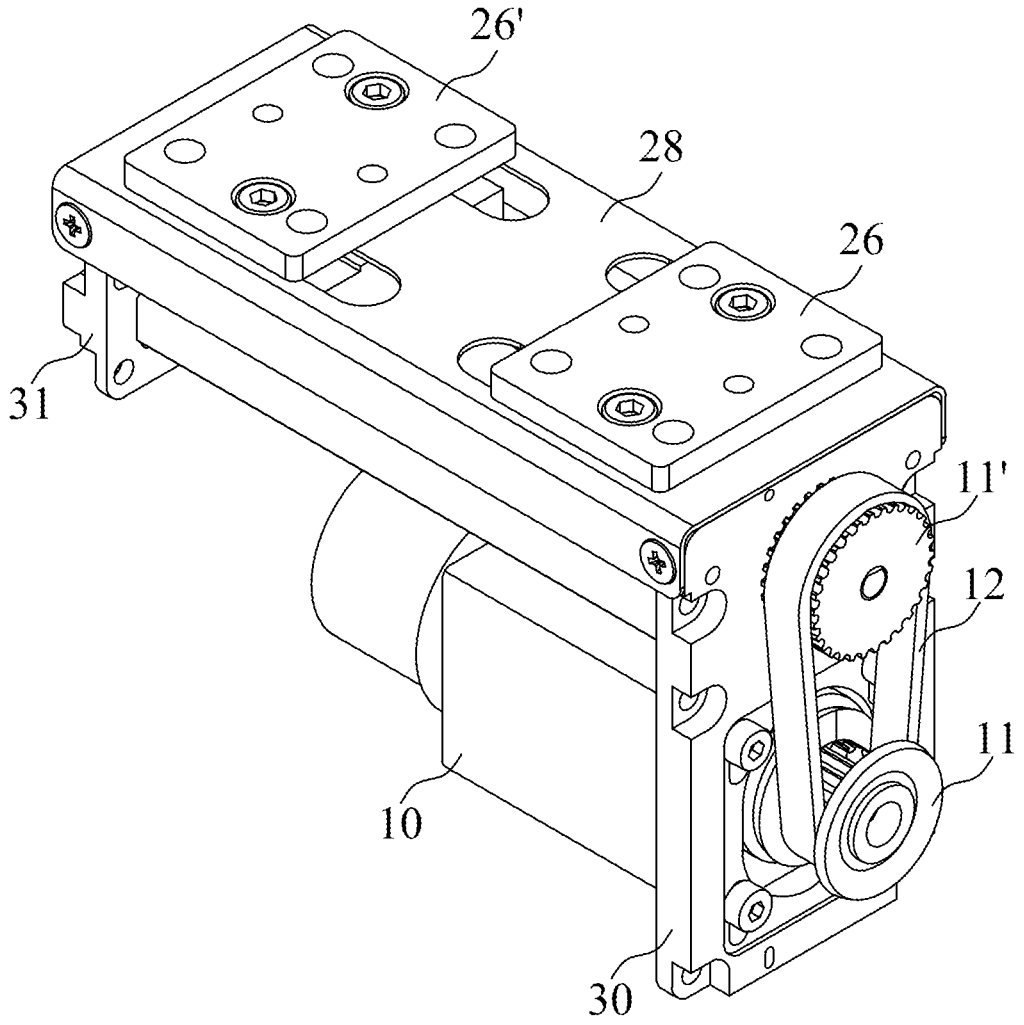
FIG. 1 is a schematic perspective view of a gripper device in a preferred embodiment.
Figure 2:
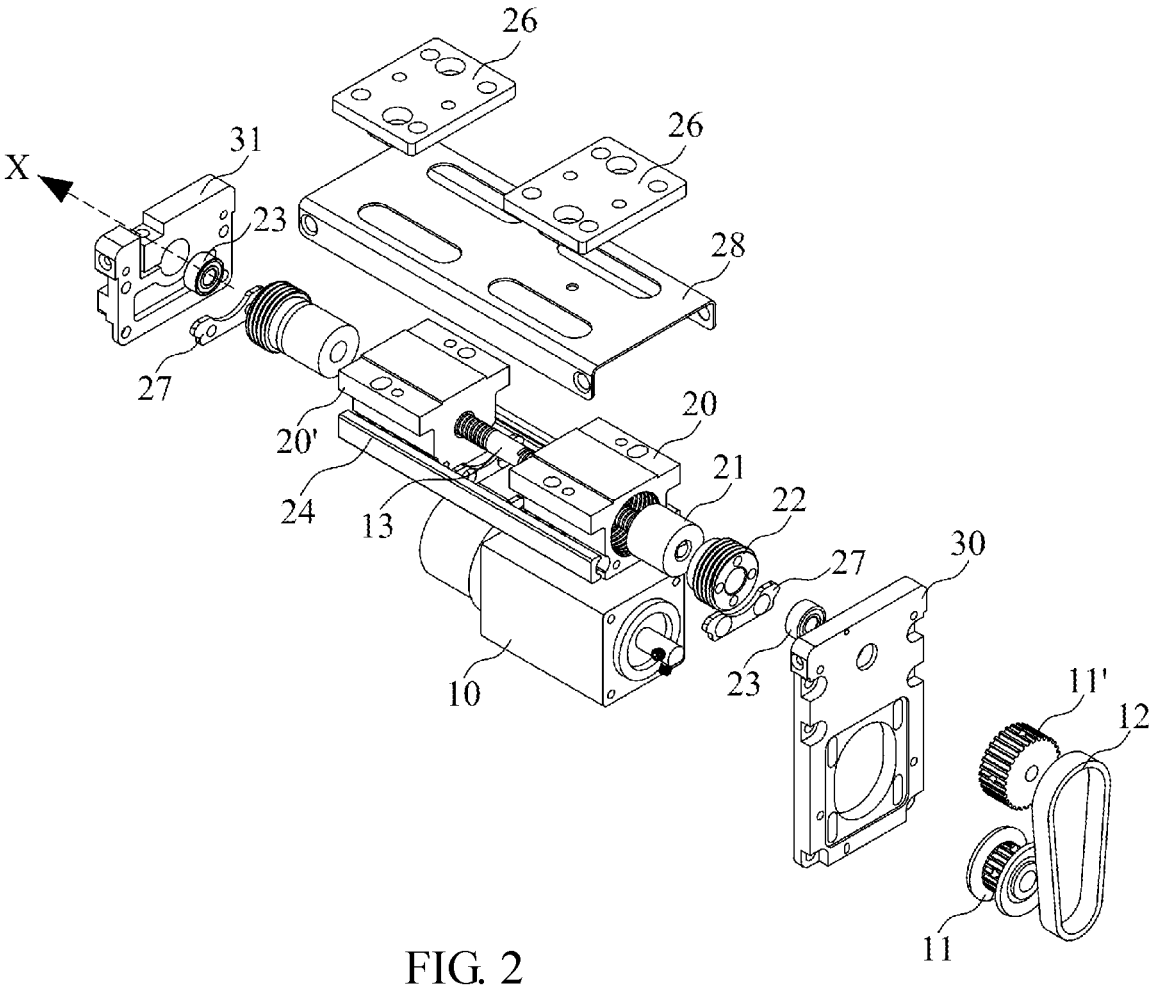
FIG. 2 is an exploded perspective view of a gripper device in a preferred embodiment.

As shown in FIG. 4*b*, the two ball nuts (21, 21') in the two nut brackets (20, 20') are driven by the two reverse threads (131, 131') at opposite sides of the ball screw (13), which has been rotating, respectively. Moreover, referring to FIGS. 2 and 5*b*, which illustrate that the ball nut (21) regulated by a packing nut (22) is limitedly shifted in the same axial direction (X) of the ball screw (13) and the nut brackets (20, 20') are shifted along two rigid guideways (24). When a workpiece (0) has been clamped by the two upper slide sockets (26, 26') on the nut brackets (20, 20') (as shown in FIG. 8), a plurality of steel balls (25) between the nut bracket (20) and the rigid guideway (24) sustain stresses (as shown in FIG. 5*b*).

In general, the nut bracket (20, 20') has a through hold space in which both the ball nut (21,21') and the packing nut (22) are accommodated and the packing nut (22) is locked, carries the upper slide socket (26, 26') thereon, and features a block-shaped structure on which components are fixed and a plurality of holes and/or grooves for accommodations of the components are opened; the ball nut (21, 21') is provided with steel balls return part with which the screw movement is transformed to the linear movement; the packing nut (22) locked in the nut bracket (20, 20') is able to limited shifts of the ball nut (21, 21'); the rigid guideway (24) on which an object is limitedly moved and shifted along a predetermined path undergoes thermal treatment for better rigidity to sustain an object's weight and/or stresses and is fixed between the first anchor plate (30) and the second anchor plate (31) (FIG. 7); the second anchor plate (31) that is a laminar structure on which components are fixed comprises a plurality of holes and/or grooves (for example, retention slots 311 in FIG. 7) for installations of components.

Preferably, the nut bracket (20) comprises two steel ball grooves (201), each of which accommodates the steel balls (25) (FIG. 5*a*) for better stability of the steel balls (25) between a rigid guideway (24) and the nut bracket (20). Moreover, a plurality of guard strips (27) installed at both sides of the nut bracket (20) additively (FIG. 5*b*) do not contact with the steel balls (25) directly for no slip-off of the steel balls (25); two ball bearings (23) installed additively are located between the packing nut (22) and the first anchor plate (30) and between the other packing nut (22) and the second anchor plate (31), respectively (FIG. 4*b*). The steel balls (25) can be stably shifted along the rigid guideways (24) with a retention slot (301) on the first anchor plate (30) and a retention slot (311) on the second anchor plate (31) abutting the rigid guideways (24) (FIG. 7). Additionally, a dustproof shell (28) mounted additively prevents the ball screw (13) from being pollution (FIG. 3*a*); the upper slide sockets (26, 26') match a plurality of fixture blocks (261, 261') for clamping a workpiece (0) steadily (FIG. 8); the fixture blocks (261, 261') are axillary components matching and fixing a workpiece (0).

Referring to FIGS. 5*c* and 6*b*, which illustrate a gripper device in the second embodiment in which the characteristics identical to those of the first embodiment in FIGS. 1, 2, 3*a*, 3*b*, 3*c*, 3*d*, 4*a*, 4*b*, 5*a*, 5*b*, 5*c*, 6*a*, 7 and 8 are not explained hereinafter. The differences in the second embodiment differing from the first embodiment are: the rigid guideways (24) in the first embodiment are replaced; the guard strips (27) are moved.

As shown in FIG. 3*a*, the power-driven motor (10) is fixed on the first anchor plate (30) and one belt pulley (11) is driven by a transmission shaft of the power-driven motor (10) clockwise or counterclockwise. Moreover, referring to FIG. 4*a*, which illustrates the belt (12) and the other belt pulley (11') are also driven by the belt pulley (11); referring to FIG. 3*c*, which illustrates the ball screw (13) is driven and rotated by the belt pulley (11') fixed on the ball screw (13).

As shown in FIG. 4*b*, the two ball nuts (21, 21') in the two nut brackets (20, 20') are driven by the two reverse threads (131, 131') at opposite sides of the ball screw (13), which has been rotating, respectively. Moreover, referring to FIGS. 2 and 5*b*, which illustrate that the ball nut (21) regulated by a packing nut (22) is limitedly shifted in the same axial direction (X) of the ball screw (13) and the nut brackets (20, 20') are shifted along two rigid guideways (24). When a workpiece (0) has been clamped by the two upper slide sockets (26, 26') on the nut brackets (20, 20') (as shown in FIG. 8), a plurality of steel balls (25) between the nut bracket (20) and a rigid guideway (24) sustain stresses (as shown in FIG. 5*b*).

Furthermore, the rigid guideway (24) comprises two guideway areas (241) and a blockage area (242) between the guideway areas (241) (FIG. 6*b*): the guideway area (241) is used to regulate movement of an object thereon within a predetermined path; the blockage area (242) prevents an object from being moved beyond the guideway area (241).

As show n in previous embodiments, a plurality of steel balls (25) are accommodated between a rigid guideway (24) and a nut bracket (20) such that the upper slide sockets (26, 26') between which a workpiece (0) is clamped sustain more stresses. Accordingly, a gripper device which is different from an ordinary gripper and referred to as creative work in applications meets patentability and is applied for the patent.

It should be reiterated that the above descriptions present the preferred embodiments, and any equivalent changes in specifications, claims or drawings still belongs to the technical field within the present disclosure with reference to claims hereinafter.

What is claimed is:

1. A gripper device, comprising:

a belt pulley driven by a transmission shaft of a power-driven motor fixed on a first anchor plate clockwise or counterclockwise;

a belt and another belt pulley, both of which are driven by said above belt pulley;

a ball screw is driven and rotated by said belt pulley fixed on said ball screw;

two ball nuts, which are accommodated inside two nut brackets and driven by two reverse threads at both sides of said ball screw, respectively, wherein said ball nut regulated by a packing nut is limitedly shifted in the same axial direction of said ball screw;

said nut brackets shifted along two rigid guideways;

said rigid guideways securely installed between a first anchor plate and a second anchor plate; and a plurality of steel balls, which are accommodated between said nut bracket and said rigid guideway and sustain more stresses when a workpiece is clamped between two upper slide sockets on said nut brackets; wherein said nut bracket comprises two steel ball grooves in which said steel balls are accommodated.

2. The gripper device as claimed in claim 1, comprising a plurality of guard strips mounted at both sides of said nut bracket.

3. The gripper device as claimed in claim 2 wherein said steel balls do not contact with said guard strips directly.

4. The gripper device as claimed in claim 1 wherein each of said rigid guideways comprises two guideway areas and a blockage area between said guideway areas.

5. The gripper device as claimed in claim 1, comprising a ball bearing between said packing nut and said first anchor plate.

6. The gripper device as claimed in claim 1, comprising a ball bearing between said packing nut and said second anchor plate.

7. The gripper device as claimed in claim 1 wherein said steel balls are stably shifted along said rigid guideway with a retention slot on said first anchor plate and said retention slot on said second anchor plate abutting said rigid guideway.

8. The gripper device as claimed in claim 1, comprising a dustproof shell which prevents the ball screw from being pollution.

9. The gripper device as claimed in claim 1 wherein said upper slide sockets match a plurality of fixture blocks to clamp a workpiece stably.

* * * * *